US006010117A

United States Patent [19]

Doxey

[11] Patent Number: 6,010,117

[45] **Date of Patent: *Jan. 4, 2000**

[54] FENCE GATE

[76] Inventor: Robert L. Doxey, 13455 Mallan Rd., Missoula, Mont. 59802

[ * ] Notice: This patent issued on a continued prosecution application filed under 37 CFR 1.53(d), and is subject to the twenty year patent term provisions of 35 U.S.C. 154(a)(2).

[21] Appl. No.: 08/734,807

[22] Filed: Oct. 22, 1996

[51] Int. Cl.[7] ..... E04H 17/00

[52] U.S. Cl. ..... 256/73; 256/65; 49/55

[58] Field of Search ..... 256/73, 59, 65, 256/68, 69, 24, 25, 26, 21, 22, 27, 28, 29, 30, 31; 49/501, 381, 396, 394, 55, 382

[56] References Cited

U.S. PATENT DOCUMENTS

| | | | |
|---|---|---|---|
| 33,927 | 12/1861 | Denham | 256/31 |
| 82,112 | 9/1868 | Green, Jr. | 49/381 |
| 99,112 | 1/1870 | Sattler | 256/24 |
| 103,483 | 5/1870 | McKee | 256/59 |
| 119,141 | 9/1871 | Hathaway | 49/394 |
| 183,503 | 10/1876 | McEntire | 49/381 |
| 265,526 | 10/1882 | Marsh | 49/396 |
| 355,249 | 12/1886 | Berry | 256/30 |
| 359,297 | 3/1887 | Town | 256/26 |
| 363,557 | 5/1887 | Smith | 256/30 |
| 399,021 | 3/1889 | Dailey | 256/65 X |
| 1,487,551 | 3/1924 | Fazekas | 49/381 |
| 2,484,413 | 10/1949 | Kouril, Jr. | 256/73 X |
| 2,588,147 | 3/1952 | Morris | 256/73 |
| 4,369,953 | 1/1983 | Greiner et al. | 256/59 X |

FOREIGN PATENT DOCUMENTS

| | | | |
|---|---|---|---|
| 3426 | 3/1888 | United Kingdom | 256/24 |

OTHER PUBLICATIONS

Reader's Digest, Complete Do–It–Yourself Manual, 1973, p. 394.

*Primary Examiner*—Harry C. Kim
*Attorney, Agent, or Firm*—Browning Bushman

[57] ABSTRACT

A fence gate having a first horizontal member, a second horizontal member in parallel relationship to the first horizontal member, a first vertical member affixed to the first and second horizontal members, and a second vertical member affixed to the first and second horizontal members in parallel relationship to the first vertical member. Each of the first and second horizontal members have an end extending outwardly of a side of the first vertical member opposite the second vertical member. Each of the first and second horizontal members have an opposite end extending outwardly of a side of the second vertical member opposite the first vertical member. These outwardly extending ends of the first and second horizontal members can be cut to size so that the fence gate can be properly affixed between fence posts of an existing fence structure.

23 Claims, 3 Drawing Sheets

FIG. 3
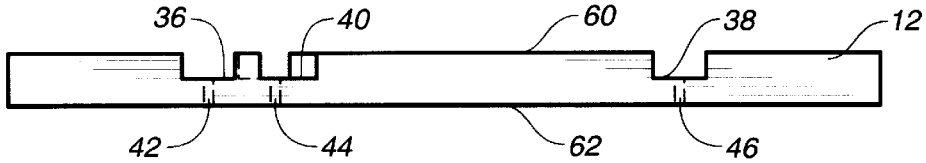
FIG. 4
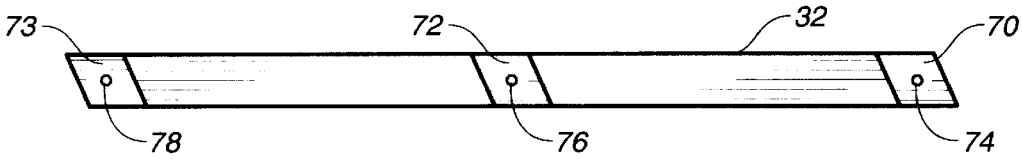
FIG. 5
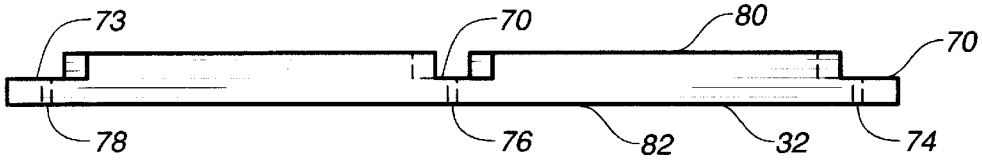
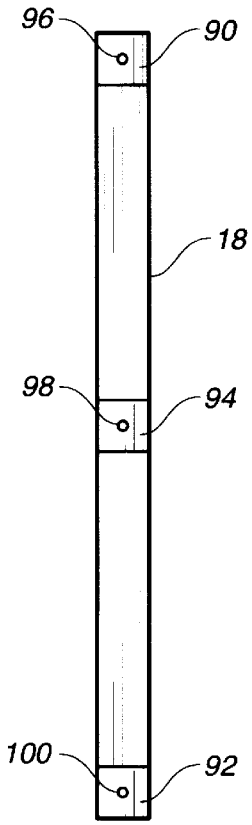
FIG. 6
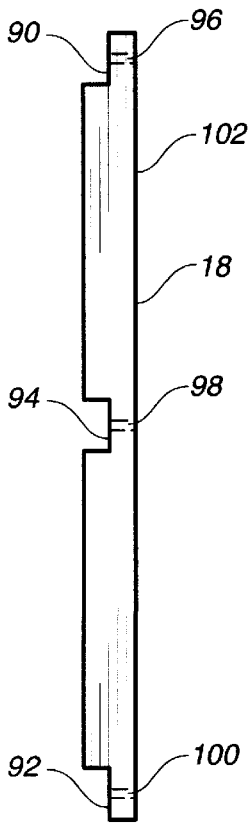
FIG. 7

FENCE GATE

TECHNICAL FIELD

The present invention relates to fence construction, in general. More particularly, the present invention relates to gates which extend between fence posts in the fence construction. Additionally, the present invention relates to fence gates that can be adapted, in size, so as to fit the dimensions between the fence posts.

BACKGROUND ART

Wooden fences are commonly used in household, commercial and industrial establishments. Conventionally, wooden fences are constructed by placing fence posts in the earth. These fence posts are embedded in the earth at desired distances from each other. Runners conventionally extend between the fence posts. Commonly, at least two horizontal runners will extend in parallel relationship between fence posts. So as to maintain the structural integrity of the wooden fence, vertical pickets are commonly nailed to these runners and extend in spaced parallel relationship from each other.

Gates are commonly applied between fence posts so as to allow entry into and exit from the fenced area. Normally, the gates are hinged to one of the fence posts so as to allow the gate to swing outwardly or inwardly. In conventional construction, the gate is commonly formed of a rectangular pattern of vertical and horizontal members. One vertical side of the gate will be hingedly connected to the fence post. Under certain circumstances, pickets or other forms of braces will extend between the vertical sides of the fence gate or between the horizontal portions of the fence gate.

Unfortunately, in virtually all circumstances, the gate must be "custom made" so as to fit the distances between the fence posts. Normally, fence posts are spaced to the desires of the owner. There is no standardized or generally accepted distance between the fence posts. As a result, it is necessary to build the gate to fit the distance between the fence posts. Heretofore, there have not been fence gates which are adaptable to the varying distances between fence posts.

It is an object of the present invention to provide a fence gate which is adaptable to the varying distances between fence posts.

It is another object of the present invention to provide a fence gate that can be mass produced.

It is a further object of the present invention to provide a fence gate that has strong structural integrity.

It is a further object of the present invention to provide a fence gate that can be stored and shipped in a compact disassembled fashion.

It is still another object of the present invention to provide a fence gate which is easy to use, easy to manufacture, and relatively inexpensive.

These and other objects and advantages of the present invention will become apparent from a reading of the attached specification and appended claims.

SUMMARY OF THE INVENTION

The present invention is a fence gate that comprises a first horizontal member, a second horizontal member in parallel relationship to the first horizontal member, a first vertical member affixed to the first and second horizontal members, and second vertical member affixed to the first and second horizontal members in parallel relationship to the first vertical member. Each of the first and second horizontal members has an end extending outwardly of a side of the first vertical member opposite the second vertical member. Each of the first and second horizontal members also has an opposite end which extends outwardly of a side of the second vertical member opposite the first vertical member.

In the preferred embodiment of the present invention, a third horizontal member is affixed to the first and second vertical members in parallel relationship to the first and second horizontal members. The third horizontal member has one end extending outwardly of the side of the first vertical member opposite the second vertical member. The third horizontal member also has an opposite end extending outwardly of the side of the second vertical member opposite the first vertical member. A diagonal brace member is affixed to the first and second horizontal members. This diagonal brace member has one end adjacent to the first vertical member and an opposite end adjacent to the second vertical member. The diagonal brace member is affixed to the third horizontal member generally centrally between the first vertical member and the second vertical member.

In the present invention, a hinge is affixed to the ends of each of the first and second horizontal members. Each hinge allows for the hinged connecting of the first and second horizontal members to a fence post. A latch is connected to the opposite end of the third horizontal member. This latch allows for the third horizontal member to be detachably affixed to an adjacent fence post opposite the fence post which has the hinge connected thereto.

Each of the first, second and third horizontal members have a first and second notch formed thereon. These notches extend thereacross transversely to the longitudinal axis of the horizontal members. Each of these notches receive the first and second vertical members therein. In the preferred embodiment of the present invention, the vertical members also have a notches formed thereon. These notches are configured so as to be in matingly received by the notches of the horizontal member. Bolt holes will extend through these notched areas so as to allow the vertical members to be affixed to the horizontal members in strong structural relationship. Also, the first, second and third horizontal members have an angled notch formed thereon. The diagonal brace member also has angled notches formed thereon. The angled notches of the diagonal brace member are matingly received by the angled notches of the first, second and third horizontal members.

In the present invention, the outwardly extending end and/or opposite end of the horizontal members can be cut transversely to the longitudinal axis of the horizontal member so as to allow the fence gate of the present invention to be appropriately adapted in size to position between the fence posts. Normally, each of the first, second and third horizontal members will have a length of approximately five feet. The outwardly extending end and opposite end of the horizontal members extend outwardly of the vertical member by at least one foot. The vertical members and the horizontal members are conventionally made of wooden material.

BRIEF DESCRIPTION OF THE DRAWINGS

FIG. 3 is a side view of one of the horizontal members.

FIG. 4 is an isolated rearward view of the diagonal brace member as used on the fence gate of the present invention.

FIG. 5 is a side view of the diagonal brace member of the present invention.

FIG. 6 is a rearward isolated view of the vertical member as used on the fence gate of the present invention.

FIG. 7 is a side view of the vertical member of FIG. 6.

DETAILED DESCRIPTION OF THE INVENTION

Figure 1:
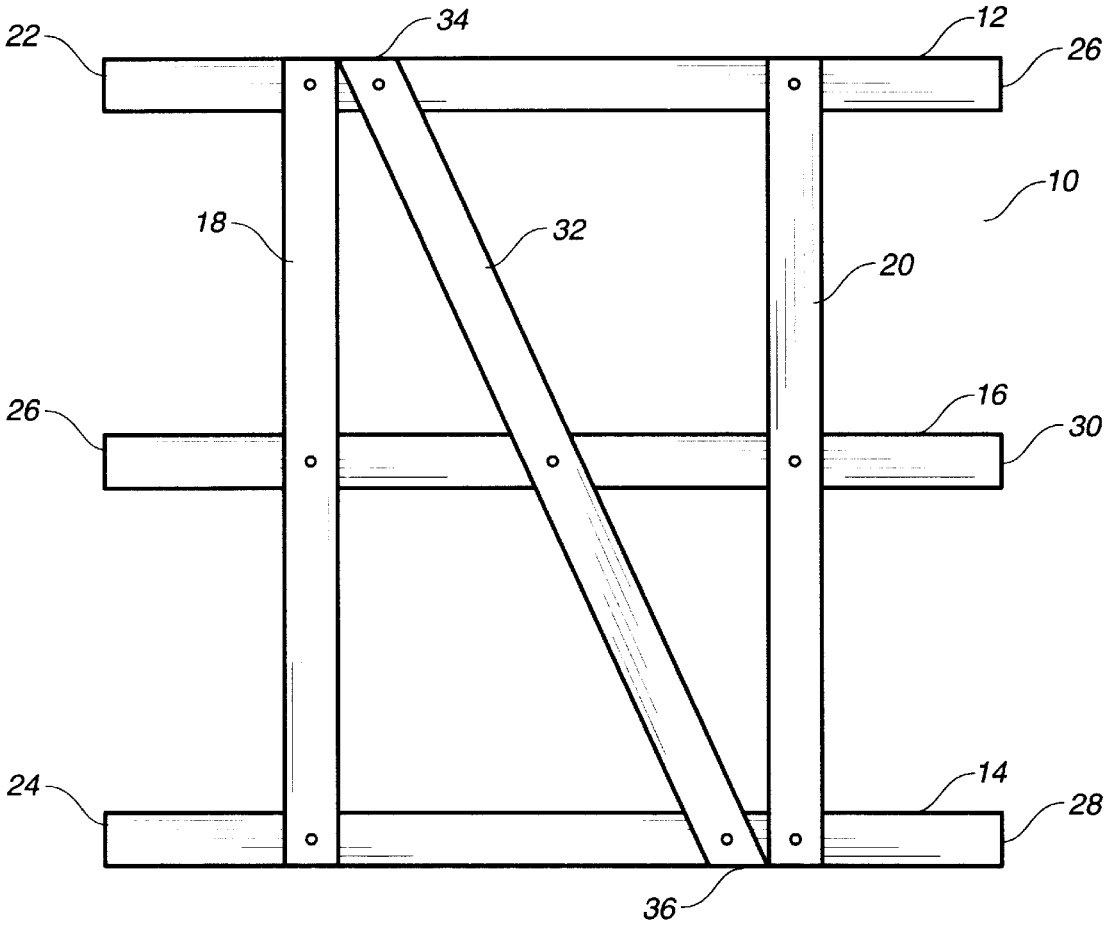
FIG. 1 is a front elevational view of the fence gate in accordance with the preferred embodiment of the present invention.

Referring to FIG. 1, there is shown at 10 the fence gate in accordance with the preferred embodiment of the present invention. The fence gate 10 includes a first horizontal member 12, a second horizontal member 14, and a third horizontal member 16. Each of the horizontal members 12, 14, and 16 are arranged in spaced parallel relationship. The fence gate 10 has a first vertical member 18 affixed to the first horizontal member 12, the second horizontal member 14 and the third horizontal member 16. The fence gate 10 also has a second vertical member 20 affixed to the first horizontal member 12, the second horizontal member 14 and the third horizontal member 16. The vertical members 18 and 20 are arranged in parallel relationship. Importantly, it can be seen that the first horizontal member 12 has an end 22 that extends outwardly for approximately one foot from a side of the first vertical member 18 opposite the second vertical member 20. The second horizontal member 14 also has an end 24 that extends outwardly for approximately one foot from a side of the first vertical member 18 opposite the second vertical member 20. The third horizontal member 16 also has an end 26 that extends outwardly for approximately one foot from a side of the first vertical member 18 opposite the second vertical member 20.

The first horizontal member 12 also has an opposite end 27 that extends outwardly for approximately one foot from a side of the second vertical member 20 opposite the first vertical member 18. The second horizontal member 14 has an opposite end 28 that extends outwardly for approximately one foot from a side of the second vertical member 20 opposite the first vertical member 18. The third horizontal member 16 has an opposite end 30 that extends outwardly for approximately one foot from a side of the second vertical member 20 opposite the first vertical member 18.

In normal use, the portion of the horizontal members 12, 14 and 16 that extends between the first vertical member 18 and the ends 22, 24 and 26, respectively, will be an area that is available for trimming so as to allow the gate 10 to be sized to the dimensions between the fence posts of the fencing system. In other words, the fence gate 10 can be properly sized by cutting transversely through these outwardly extending portions. Similarly, the portion of the horizontal members 12, 14 and 16 that extends between the second vertical member 20 and the opposite ends 27, 28 and 30, respectively, can also be trimmed so as to allow the gate 10 to be sized to the proper dimensions between the fence posts of the fencing system. In this manner, the fence gate 10 is properly adaptable to the spacing requirements of each individual fencing system.

In the present invention, it can be seen that a diagonal brace 32 is affixed, at one end, to the first horizontal member 12 and at the opposite end to the second horizontal member 14. The diagonal brace 32 has an end 34 which is adjacent to the first vertical member 18. The diagonal brace 32 has an opposite end 36 which is adjacent to the second vertical member 20. The diagonal brace 32 is also affixed to the third horizontal member 16 centrally between the first vertical member 18 and the second vertical member 20. The incorporation of the diagonal brace 32 greatly improves the structural integrity of the gate 10 of the present invention. The diagonal brace 32 will extend between the inner sides of the first vertical member 18 and the second vertical member 20. As can be seen in FIG. 1, each of the horizontal members 12, 14 and 16 is bolted to each of the vertical members 18 and 20. Similarly, the diagonal brace 32 is bolted to the first, second and third horizontal members.

Figure 2A:
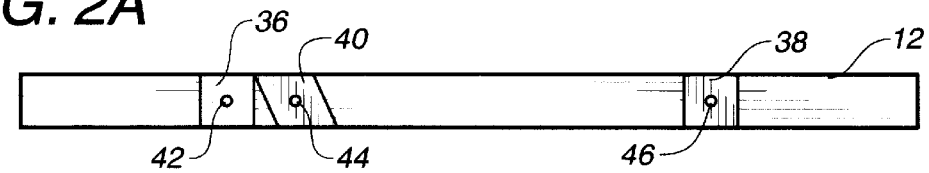
FIGS. 2A–C show isolated frontal views of each of the horizontal members.

FIG. 2A is an isolated view of the horizontal member 12. It can be seen that the horizontal member 12 has a first notch 37 and a second notch 38 formed therein. These notches 37 and 38 extend transversely to the longitudinal axis of the horizontal member 12. An angled notch 40 also is formed in the horizontal member 12 generally adjacent to the first notch 37. Suitable bolt holes 42, 44 and 46 are formed through the horizontal member 12 at the notches 37, 40 and 38, respectively.

Figure 2B:
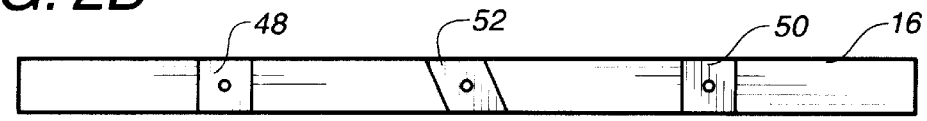

FIG. 2B shows the third horizontal member 16. It can be seen that the horizontal member 16 has a first notch 48, a second notch 50 and an angled notch 52. The notches 48 and 50 have a configuration similar to the notches 37 and 38 of the first horizontal member 12. The angled notch 52 is formed generally centrally between the notches 48 and 50.

Figure 2C:
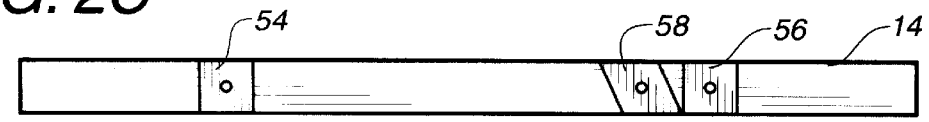

FIG. 2C shows the second horizontal member 14. The second horizontal member 14 has a first notch 54, a second notch 56, and an angled notch 58. The angled notch 58 is formed generally adjacent to the second notch 56. The notches 54 and 56 have a configuration similar to the notches of the horizontal members 12 and 16. The angled notch 58 is formed adjacent to the second notch 56.

FIG. 3 is a side view of the first horizontal member 12. This view, as shown in FIG. 3, shows how the notches 37 and 38 are formed into the surface 60 of the horizontal member 12. Each of the notches 37 and 38 extends downwardly into the horizontal member 12 for about half of the thickness of the horizontal member 12. The angled notch 40 also extends into the horizontal member 12 for approximately half of the thickness. The angling of the notch 40 is shown in broken line fashion in FIG. 3. It can be seen that bolt holes 42, 44 and 46 extend from the bottom of the notches 37, 40 and 48, respectively, and open on the back side 62.

The horizontal members 14 and 16 will also have a similar configuration, but for the placement of the angled notches.

FIG. 4 illustrates the diagonal brace 32. The diagonal brace 32 has a first notch 70, a second notch 72 and a third notch 73 formed therein. It can be seen that a bolt hole 74 is formed at the notch 70. A bolt hole 76 is formed at the notch 72. A bolt hole 78 is formed at the notch 73.

FIG. 5 shows how the notches 70, 72 and 73 are formed in the surface 80 of the diagonal brace 32. The bolt holes 74, 76 and 78 are illustrated as extending from the notched areas so as to open at the side 82 of the diagonal brace.

In normal construction, the notched area 73 will be matingly received by the angled notch 40 of the first horizontal member 12. The notched area 72 will be matingly received by the angled notch 52 of the third horizontal member 16. The angled notch 70 will be matingly received by the angled notch 58 of the second horizontal member 14. The interlocking nature of the notches 70, 72 and 73 of the diagonal brace 32 and the respective notches of the horizontal members 12, 14 and 16 provides for strong structural integrity between the diagonal brace 32 and the horizontal members 12, 14 and 16. By placing a bolt through the respective aligned bolt holes, the diagonal brace 32 can be fixedly secured to the horizontal members 12, 14 and 16. When the diagonal brace 32 is joined to the horizontal members 12, 14 and 16, the thickness at the area of the notched and mating connection will be equal to the thickness of one of the horizontal members. As a result, the assembled fence gate 10 will have a generally flat profile.

FIG. 6 shows the vertical member 18. The vertical member 20 will have a configuration identical to the vertical member 18. The vertical member 18 has a first notched area 90, a second notched area 92 and a third notched area 94. A bolt hole 96 is formed in the notched area 90. A bolt hole 98 is formed in the notched area 94. A bolt hole 100 is formed in the notched area 92. The notched area 94 is formed generally centrally between the notched areas 90 and 92.

As can be seen in FIG. 7, the vertical member 18 has notched area 90 formed through approximately one-half of the thickness of the vertical member 18. Similarly, the second notched area 92 and the notched area 94 are formed through half of the thickness of the vertical member 18. The respective bolt holes 96, 98 and 100 will extend from the respective notched areas so as to open at the opposite side 102 of the vertical member 18.

In actual use, the notched area 90 will be received within the notched area 37 of the first horizontal member 12. The second notched area 92 will be received within the notched area 54 of the second horizontal member 14. The third notched area 94 will be received within the notched area 48 of the third horizontal member 16. A similar application of the second vertical member 20 will occur within the notched areas 38, 50 and 56 of the respective horizontal members. Bolts can be installed through the respective bolt holes so as to secure the horizontal members to the vertical members in a bolted fashion.

Figure 8:
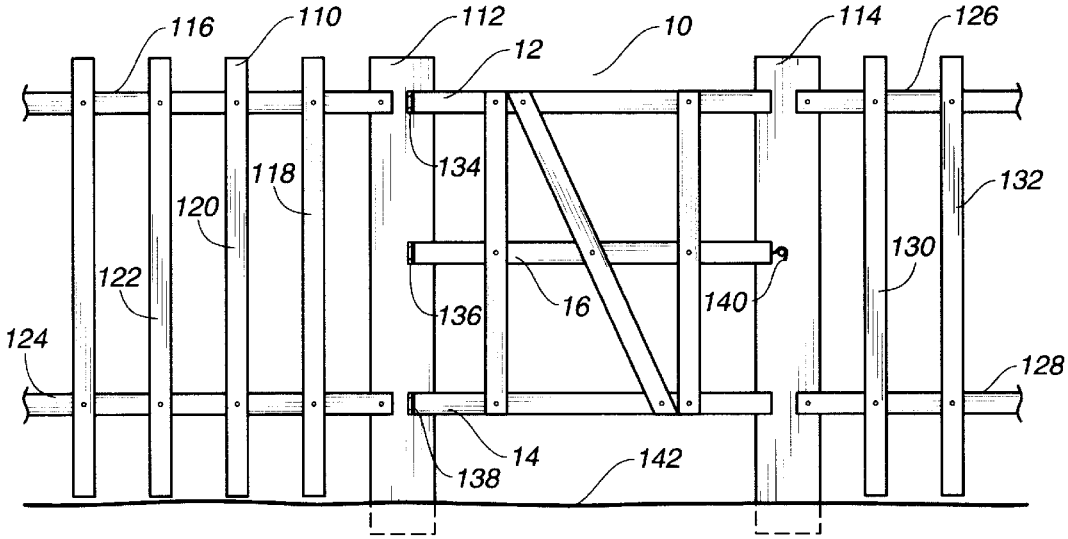
FIG. 8 shows the application of the fence gate of the present invention in a fencing system.

FIG. 8 shows the application of the gate 10 in a fencing system 110. It can be seen that the fencing system 110 has a first fence post 112 and a second fence post 114. Runners 116 extend horizontally outwardly from one side of the first fence post 112. Pickets 118, 120 and 122 are fixed to the runner 116. A second runner 124 also extends outwardly from the same side of the fence post 112. The pickets 118, 120 and 122 are also affixed to the second horizontal runner 124.

In a similar fashion, horizontal runners 126 and 128 extend outwardly from a side of the second fence post 114. The runners 126 and 128 are arranged in parallel relationship. Pickets 130 and 132 extend vertically between the horizontal runners 126 and 128 and are affixed thereto in generally parallel relationship. Importantly, the fence gate 10 of the present invention is hingedly connected at one end to the first fence post 112. Hinges 134, 136 and 138 serve to secure the first horizontal member 12, the third horizontal member 16 and the second horizontal member 14, respectively, to the first fence post 12. The outwardly extending portions of the horizontal members 12, 14 and 16 can be appropriately cut, as described herein before, prior to attaching the hinges 134, 136 and 138. The hinging of the gate 10 to the first fence post 112 allows the gate 10 to swing outwardly and to open. A latch member 140 is affixed to the second fence post 114 and to the outwardly extending opposite end of the third horizontal member 16. Latch member 140 allows the gate 10 to be maintained, in a closed condition, against the second fence post 114. By releasing the latching mechanism 140, the gate 10 can be rotated about the hinges 134, 136 and 138 so as to appropriately open the gate 10. It can be seen in FIG. 8 that the fence posts 112 and 114 are embedded into the earth 142.

Figure 9:
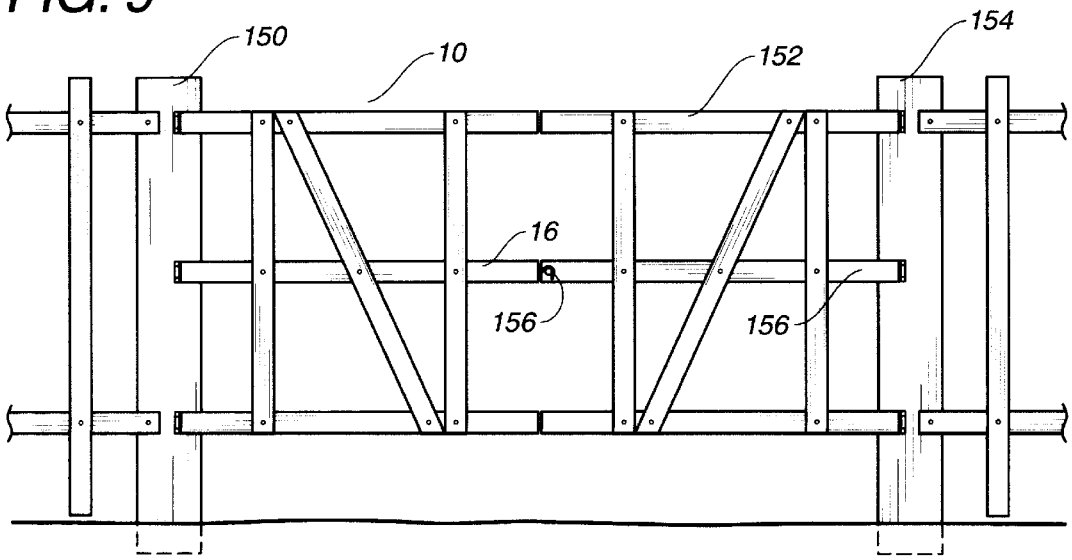
FIG. 9 is an alternative view of a use of the fence gate of the present invention in a fencing system.

FIG. 9 shows an alternative use for the gate 10 of the present invention. It can be seen that the gate 10 is hingedly secured to a first fence post 150. Similarly, a second gate 152 is hingedly secured to a second fence post 154. The second gate 152 has a configuration identical to the gate 10. The second gate 152 extends from the second fence post 154 in a direction toward the first fence post 150. Similarly, the first gate 10 extends from the first fence post 150 toward the second fence post 154. The gates 10 and 152 serve to provide a double-wide, double-opening gate system. As can be seen, a latch mechanism 156 is formed on the third horizontal member 16 of the gate 10 and is formed onto a horizontal member 158 of the gate 152. This latch mechanism allows for gate 10 to be secured to the gate 152 in a closed fashion. The releasing of the latch mechanism 156 will allow the gates 10 and 152 to be rotated about their respective hinges so as to open to the area interior of the fence.

It can be seen that the present invention provides a gate system that can be adapted to the varying distances between fence posts. By simply removing a portion the outwardly extending end and/or opposite end of the horizontal members, the gate 10 of the present invention can be sized to the particular requirements of the fence posts of the gate system. It is no longer necessary to "customize" each of the gates to the area between the fence posts. Furthermore, the fence gate of the present invention can be mass produced and sold in a fashion such that the fence owner can buy one size and adapt that one size easily to fit his or her requirements. The structural arrangement of the fence gate 10 of the present invention allows for easy manufacture and easy assembly. The interlocking notches of the various components assure a strong system. This arrangement also provides foolproof assembly. The notched arrangements allow for the gate to be formed with a generally flat profile.

Since each of the horizontal and vertical members of the gate 10 of the present invention is formed of a similar cross-sectional sized piece of wood, each of the pieces can be easily stacked and arranged for storage and shipment. Manufacturing is easy in view of the similar nature and locations of the various notches. As such, the present invention can be manufactured in a relatively inexpensive manner.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A fence gate comprising:

a first horizontal member;

a second horizontal member in parallel relationship to said first horizontal member;

a first vertical member affixed to said first and second horizontal members;

a second vertical member affixed to said first and second horizontal members in parallel relationship to said first vertical member, each of said first and second horizontal members having an end extending outwardly of a side of said first vertical member opposite said second vertical member, each of said first and second horizontal members having an opposite end extending outwardly of a side of said second vertical member opposite said first vertical member, at least one of said outwardly extending end and opposite end of each of said first and second horizontal members having an axial length that is severable for reducing an axial length of said respective first and second horizontal members by at least approximately twenty percent (20%); and a hinge operatively connected to said first and second horizontal members for hingedly securing said fence gate to a fence post.

2. The fence gate of claim 1, wherein said first horizontal member includes a first notch and a second notch extending thereacross transverse to a longitudinal axis of said first horizontal member, said second horizontal member having a first notch and a second notch extending thereacross transverse to a longitudinal axis of said second horizontal member, said first vertical member being received within said first notches of said first and second horizontal members, said second vertical member being received within said second notches of said first and second horizontal members.

3. The fence gate of claim 2, wherein said first vertical member includes a first notch and a second notch and said second vertical member includes a first notch and a second notch, said first notch of said first vertical member matingly received by said first notch of said first horizontal member, said second notch of said first vertical member matingly received by said first notch of said second horizontal member, said first notch of said second vertical member matingly received by said second notch of said first horizontal member, and said second notch of said second vertical member matingly received by said second notch of said second horizontal member.

4. The fence gate of claim 3, wherein each first and second notch of said first and second horizontal members and each first and second notch of said first and second vertical members include a bolt hole extending therethrough.

5. The fence gate of claim 4 further comprising:

a bolt received through each bolt hole of said first and second horizontal members and through each corresponding bolt hole of said first and second vertical members.

6. The fence gate of claim 1, further comprising:

a first fence post hingedly connected to said end of each of said first and second horizontal members.

7. The fence gate of claim 6, further comprising:

a second fence post having a latch connected thereto for detachably connecting to said opposite end of at least one of said first and second horizontal members.

8. The fence gate of claim 7, wherein said first and second fence posts are adapted to be affixed within the earth in generally parallel relationship to each other, said first and second horizontal members extending between said first and second fence posts.

9. The fence gate of claim 6, further comprising:

a second fence post; and a gating member hingedly connected to said second fence post and extending from said second fence post toward said first fence post, said gating member having a latch affixed thereto for detachably receiving said opposite end of at least one of said first and second horizontal members of said fence gate.

10. The fence gate of claim 9, wherein said gating member further comprises:

a first horizontal member;

a second horizontal member in parallel relationship to said first horizontal member;

a first vertical member affixed to said first and second horizontal members; and a second vertical member affixed to said first and second horizontal members in parallel relationship to said first vertical member, each of said first and second horizontal members having an end extending outwardly of a side of said first vertical member opposite said second vertical member, each of said first and second horizontal members having an opposite end extending outward of a side of said second vertical member opposite said first vertical member, each end and opposite end of each first and second horizontal member having an axial length that is severable for reducing an axial length of said respective first and second horizontal members by at least approximately twenty percent (20%).

11. The fence gate of claim 1, wherein said axial length of each outwardly extending end and opposite end of said first horizontal member is greater an twenty-five percent (25%) of the axial length of said first horizontal member, and said axial length of each outwardly extending end and opposite end of said second horizontal member is greater than twenty-five percent (25%) of the axial length of said second horizontal member.

12. A fence gate comprising:

a first horizontal member;

a second horizontal member in parallel relationship to said first horizontal member;

a first vertical member affixed to said first and second horizontal member;

a second vertical member affixed to said first and second horizontal members in parallel relationship to said first vertical member, each of said first and second horizontal members having an end extending outwardly of a side of said first vertical member opposite said second vertical member, said end of each of said first and second horizontal members having an axial length that is severable for reducing an axial length of said respective first and second horizontal members by at least approximately twenty percent (20%);

a third horizontal member affixed to said and second vertical member in parallell relationship to said first and second horizontal member, each if said first and second vertical members and each if said first, second and third horizontal member having equal cross-sectional areas in a plane tranverse to a longitudinal axis of said first and second vertical members and said first, second and third horizontal members; and a hinge operatively connected to said first and second horizontal members for hingedly securing said fence gate to a first fence post.

13. The fence gate of claim 12, wherein said third horizontal member includes an end extending outwardly of the side of said first vertical member opposite said second vertical member, said end of said third horizontal member having an axial length that is severable for reducing an axial length of said third horizontal member by at least approximately twenty percent (20%).

14. The fence gate of claim 13, wherein said first, second and third horizontal members include an opposite end extending outwardly of a side of said second vertical member opposite said first vertical member, said opposite end of each first, second and third horizontal member having an axial length that is severable for reducing axial length of said respective first, second and third horizontal members by at least approximately twenty percent (20%).

15. The fence gate of claim 14 further comprising:

a latch connected to said opposite end of at least one of said first, second and third horizontal members for releasably securing said opposite end to a second fence post.

16. A fence gate comprising:

a first horizontal member;

a second horizontal member in parallel relationship to said first horizontal member;

a first vertical member affixed to said first and second horizontal members;

a second vertical member affixed to said first and second horizontal members in parallel relationship to said first vertical member, each of said first and second horizontal members having an end extending outwardly of a side of said first vertical member opposite said second vertical member, said end of each of said first and second horizontal members having an axial length that is severable for reducing an axial length of said respective first and second horizontal members by at least approximately twenty percent (20%);

a diagonal brace member affixed to said first horizontal member and said second horizontal member, said second horizontal member having an angled notch formed therein generally adjacent to said second vertical member, said diagonal brace member having one end adjacent said first vertical member and an opposite end adjacent said second vertical member, said first horizontal member having an angled notch formed therein generally adjacent to said second vertical member, said second horizontal member having an angled notch formed therein generally adjacent to said second vertical member, said diagonal brace member received within said notches of said first and second horizontal members, said diagonal brace member having a first angled notch formed at one end and a second angled notch formed at an opposite end, said first angled notch matingly received by said angled notch of said first horizontal member, said second angled notch of said diagonal brace member matingly received by said angled notch of said second horizontal member, said diagonal brace member having a thickness at said first angled notch equal to a thickness of said first horizontal member at said angled notch, said diagonal brace member having a thickness at said second angled notch equal to a thickness of said second horizontal member at said angled notch; and a hinge operatively connected to said first and second horizontal members for hingedly securing said fence gate to a fence post.

17. The fence gate of claim 16, further comprising:

a third horizontal member affixed to said first and second vertical members in parallel relationship to said first and second horizontal members, said diagonal brace member being affixed to said third horizontal member centrally between said first vertical member and said second vertical member.

18. A fence gate comprising:

a first horizontal member;

a second horizontal member in substantial parallel relationship to said first horizontal member;

a first vertical member affixed to said first and second horizontal members;

a second vertical member affixed to said first and second horizontal members in substantial parallel relationship to said first vertical member, said first and second vertical members defining a space there between, each first and second horizontal member including an end extending outwardly of a side of at least one of said first and second vertical members opposite said space, each end having an axial length that is severable for reducing an axial length of said respective first and second horizontal members by at least approximately twenty percent (20%); and a hinge operatively connected to said first and second horizontal members for hingedly securing said fence gate to a fence post.

19. The fence gate of claim 18, wherein each first and second horizontal member includes an opposite end extending outwardly of another side of said at least one of said first and second vertical members opposite said respective end.

20. The fence gate of claim 18, further comprising:

a diagonal brace member affixed to said first and second horizontal members, said diagonal brace member positioned in said space and extending from one end adjacent said first vertical member to another end adjacent said second vertical member.

21. The fence gate of claim 18, further comprising:

a third horizontal member affixed to said first and second vertical members in substantial parallel relationship to said first and second horizontal members.

22. The fence gate of claim 21, wherein said third horizontal member includes an end extending outwardly of the side of said at least one of said first and second vertical members opposite said space.

23. The fence gate of claim 22, wherein said third horizontal member includes an opposite end extending outwardly of another side of another said at least one of said first and second vertical members opposite said respective end.

* * * * *